US005152034A

United States Patent [19]

Konings et al.

[11] Patent Number: 5,152,034

[45] Date of Patent: Oct. 6, 1992

[54] CLICK-CLIP

[76] Inventors: Frederikus J. J. Konings, 28, Huygenslaan, 3818 WC Amersfoort; Frans J. Roling, 45 Baarnseweg, 3734 CA Den Dolder, both of Netherlands

[21] Appl. No.: 599,895

[22] Filed: Oct. 19, 1990

[51] Int. Cl.[5] ..... B65D 63/10

[52] U.S. Cl. ..... 24/30.5 R; 24/487

[58] Field of Search ..... 24/487, 30.5 R, 30.5 P, 24/30.5 S, 532, 545, 555, 559

[56] References Cited

U.S. PATENT DOCUMENTS

| | | | |
|---|---|---|---|
| D. 218,515 | 8/1970 | Tomaiuolo | 24/30.5 R |
| 4,807,334 | 2/1989 | Blanchard | 24/487 |
| 4,811,465 | 3/1989 | Folkmar | 24/30.5 R |

FOREIGN PATENT DOCUMENTS

| | | | |
|---|---|---|---|
| 1475241 | 4/1969 | Fed. Rep. of Germany | 24/487 |
| 8602618 | 5/1986 | World Int. Prop. O. | 24/30.5 R |

*Primary Examiner*—Laurie K. Cranmer

[57] ABSTRACT

A bag closure device made of an extruded synthetic resin material comprising relatively stiff wing portions connected by a living hinge wherein each wing portion has a foot portion with a hook portion at the end thereof for mutual interlocking.

3 Claims, 2 Drawing Sheets

CLICK-CLIP

The invention relates to a method for manufacturing a bag closure device of a synthetic resin material, which device is to be adapted for closing, reopening and reclosing respectively of bag edges made from a plastic film or similar material having a single thickness varying between 0.01 and 1 mm.

The invention also relates to a method for closing, reopening and reclosing respectively of a bag by means of a bag closure device made according to the invention. In a preferred embodiment, the bag closure device according to the invention is made of an extruded synthetic resin material, preferably a polypropylene material.

Up till now, bags which are made of a plastic film material or the like, are made reclosable by a large variety of known interlockable devices which generally operate in such a way that a longitudinally shaped female member is attached to an edge of the plastic film material whereas an oppositely disposed longitudinally shaped male member is attached to the opposite plastic film material. By means of exerting a certain pressure force, or reversely exerting a certain tearing force respectively, the locking or unlocking operation respectively of the bag closure device can be realized.

The invention includes a novel method to manufacture a hingeable bag closure device which can be used many times in closing, reopening and reclosing operations without losing its optimal characteristics and moreover the novel bag closure device can be exposed to temperatures between minus 20° Celsius and plus 70° Celsius and yet it fully retains all of its required characteristics as a closure device. Under these circumstances, and within considerable temperature ranges, the invention is particularly valuable in that it provides for a novel bag closure device which, while being of plastic material, yet can also withstand the physical performance of being subjected to electronic heating in a microwave oven. Under all circumstances the closure bag device can be used for any package that must be reclosed and thereafter again be reopened, which actions are e.g. repeatedly effected for all kind of bags containing food products. This novel method and bag closure device guarantee a tight closure and reclosure of the bag, thereby avoiding any and all tiny insects which may tend to enter into the bag through its closed end.

Figure 1:
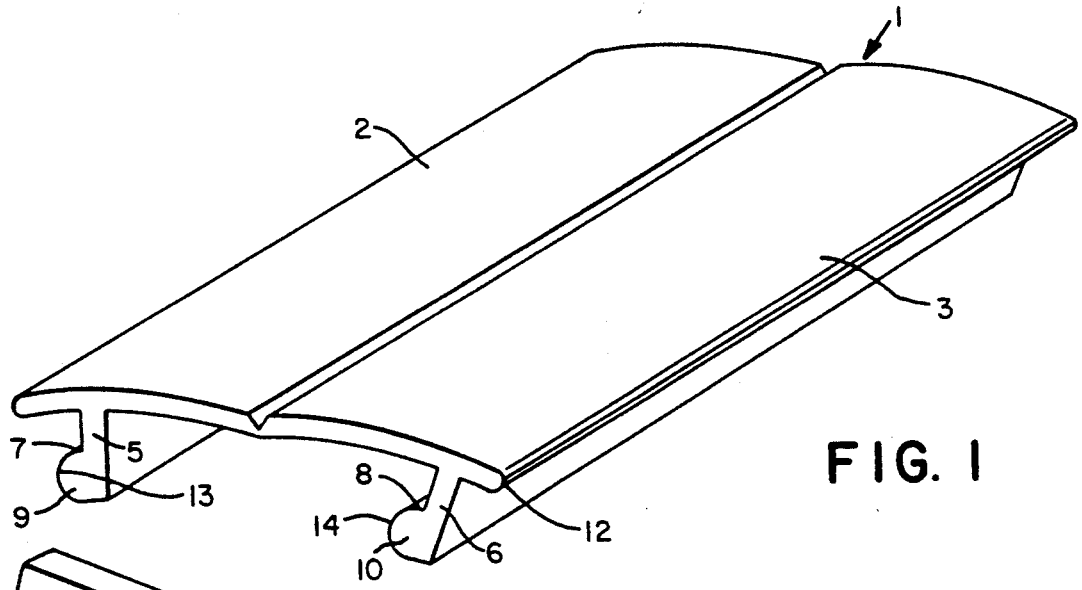
FIG. 1 is a perspective view of the present invention in an open position.
Figure 2:
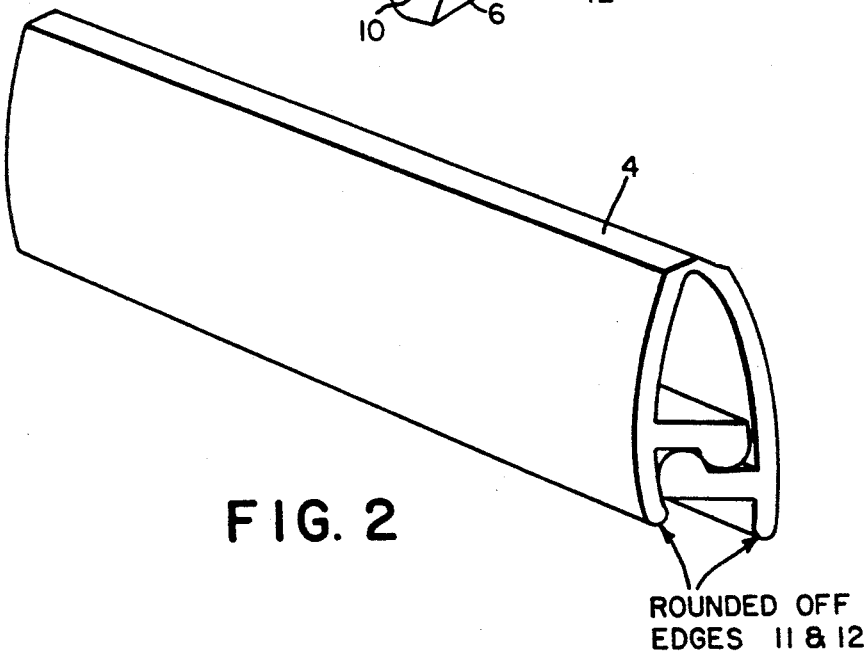
FIG. 2 is a perspective view of the present invention in a closed position.
Figure 3:
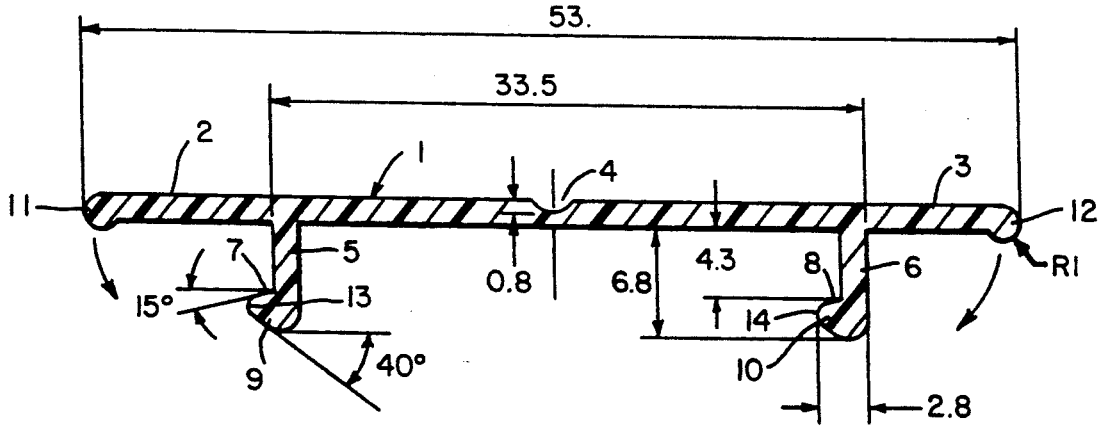
FIG. 3 is a sectional view of the present invention.

According to the invention manufacturing of the bag closure device is realized by carrying out the following steps:

a. extruding a flat or nearly flat double winged strip, in a cross-sectional view, each wing having the same or nearly the same width and while being of a substantial thickness, each wing portion of said double wing being provided at oppositely directed side ends, in the vicinity of each of its outer wing edges, with a depending and protruding hook portion, each hook at the end of said hook portion pointing in the same direction away from a foot portion which connects the hook portion to the wing;

b. simultaneously extruding an interconnecting joint, which operates as a hinged portion between adjacent wing portions of the bag closure device, between said two wings. The interconnecting portion, in a cross-sectional view, is much less in thickness than the general thickness of the double winged strip. The position of said interconnecting joint is defined slightly offset or excentrically positioned with respect to half the distance between the foot portions of the protruding hook portions and c. cutting the extruded strip into pieces of required lengths, corresponding to the widths of the multifold upper bag portions.

At the same time the manufacturing of the bag closure device can be additionally improved int hat its surface can be provided with helpfull printed information e.g. about the packed product and in various languages. To prepare the surface of said closure bag device the following steps are carried out:

a. the upper surface of each cut off double winged bag closure device is first pretreated by means of a physical surface treatment, preferably with a chemical agent, to lower its surface tension and for making said surface readily accessible to a printing action thereby using a special printing ink and b. printing the upper wing surface, e.g. with text portions followed by intermittently drying and heating respectively of the printed surface and thereafter cooling the printed surface for a period of time, e.g. for 20 seconds.

The invention further provides for a novel method for closing, reopening and reclosing a bag of plastic film material having a thickness varying between 0.01 and 1 mm, by means of a bag closure device made according to the invention, while applying the following steps:

a. bending the individual wings from an extruded position of 180°, in a cross-sectional view, into a hingeable position wherein the individual wings than assume a sharp angled position with respect to their interconnecting joint portion which than operates as a durable hinge, a twin folded bag end portion being interposed in the sharp angled wing space thereby being positioned beyond the protruding hook portions; and b. external pressure being lengthwise exerted upon and along the two individual wings, thereby simultaneously clipping the hooks interlockingly together over the frictionally engaged film material of the bag, thereby placing the twin folded foil material into a definite zigzag position for pertinently closing the end portion of said bag and c. reversely, while for opening the bag closure device, than exerting an opening force at one or both sides upon each longitudinal end of the wings to gradually diverge and open up the bag closure device lengthwise from its fully locked position by spreading the wings from a sharp angled position to a fully open position wherein the end portion of said bag is unlocked from the interlocking position of said hooks.

A bag closure device according to the invention is made of an extruded synthetic resin material nd consists of a couple of relatively stiff wing portions, integrally interconnected by an intermediate hinged central joint portion, wherein the average thickness of said central portion is substantially less than the general thickness of each wing, thereby establishing lengthwise a durable central hinge, known per se, and depending downwardly from each lower wing surface there is a protruding foot portion which at its lowermost end is provided with a hook portion for interlocking purposes, both hook portions pointing away in the same direction which is generally parallelly disposed with respect to the 180° flatly stretched surface of the double wings, each foot portion being slightly offset with respect to the central hinging line and its cooperating hook portion, enabling an optimal interlocking action between the hooks and the end portions of said bag.

Another improved bag closure device according to the invention is characterized in that the foot portions are just long enough to enable optimal flexibility and yet offer sufficient resistance against unlocking force exertion, to cope with the possible variety in thicknesses of interposed bag film material.

In a preferred embodiment of the bag closure device, in a cross-section, each wing has a width of about 50 mm, the distance between said foot portions being about 30 mm, the height of the foot portions being identical and about 7 mm and the hooks being identical and having the shape of a rectangular triangle with one side being in line with one protruding surface of the foot portion, the angles pointing parallely to the flat surface of the wing and the angle pointing outwardly from the foot portion both being of rounded off shape.

In another preferred embodiment of the bag closure device, in cross section, the locking angle of each hook portion is at an angle of about 15° from the line running parallel to the wing surface and in which the hypotenuse of the triangle runs at an angle of about 40° reversely directed with respect to said line.

In practice it has been found that a bag closure device according to the invention is most preferred in which the thickness of a wing is between 1.4 and about 2 mm, the thickness of the hinged portion being between about 0.6 and about 0.9 mm, the height of the foot portion being between about 4 and 5 mm and it is also an advantage if each opposite free outer wing edge is provided with a thicker and rounded off rim having a radius of at least about 1 mm and if it is made of a type of polypropylene specially adapted for durable long life hinging operation.

Because of it slightly reliable operation the interlockable closure device according the invention can be used also as a multipurpose spanner for whatever purpose and thereby contain any and all of the main characteristic constructional features as described before and it can e.g. be used for any possible application with any flexible sheet or similar material to be interlocked while assuming a zigzagged position between the said opposed hook portions.

A preferred embodiment of the invented bag closure device is shown in the drawing in which the extruded polypropylene double wing profile 1, here shown in a cross section, consists of a left wing portion 2 and a right wing portion 3 interconnected by a shallow central hinge portion 4. Depending down from the main double wing profile are the foot portions 5 and 6 which each are provided with hooked portions 7 and 8 of which the hooks 9 and 10 are pointing to the same direction. The extruded bag closure device is cut to its desired length and for performing its operation the outer ends 11 and 12 of the wing portions 2 and 3 are brought together in the direction of the arrows and if a film material is interposed between the hooked portions than it is zigzagged between the hooks and an interlocking operation between these hooks is obtained. A perfect opening and reclosing of the bag closure device is not only desired if a film bag is interposed between the wings, but the rather inflexible polypropylene material must also lengthwise be reopened in the event that the hooks are in an interlocked position. By the adaptation of a high extrusion precision technique in conjunction with the surface characteristics of the film material to be held between the hooks, the bag closure device can meet all requirements an it has an extremely good grip upon the film material under all temperature conditions. Tests were conducted to ensure optimal interlocking operation together with sufficient flexibility for opening and reclosing. In the described embodiment of the bag closure device the total width of the double wing is 53 mm, the distance between the opposite outer foot portions is 33.5 mm, the depth of the shallow hinge groove is 0.8 mm. The height of the hooked portions from the underside of a wing is 6.8 mm and the distance from the underside of the wing till the underside of the hook is 4.3 mm. The dimensions of the hook have a width of 2.8 mm and a height of 2.5 mm having rounded off portions 13 and 14 which are angled under 15° and 40° as shown in the drawing.

Furthermore the outer wing ends are also rounded off in order to protect the foil bag against sharp incidental cuts.

We claim:

1. A plastic film, bag closure device composed of an extruded resin material, said bag closure device comprising:

a first generally rectangular wing portion having elongate lateral side edges, and edges and a generally uniform thickness;

a second generally rectangular wing portion having elongate lateral side edges, end edges and a generally uniform thickness;

an intermediate hinge portion integrally joining adjacent elongate lateral side edges of said first and second rectangular wing portions, said intermediate hinge portion having a thickness less than the thickness of said first and second generally rectangular wing portions to facilitate pivotal motion of said first generally rectangular wing portions with respect to said second generally rectangular wing portion about said intermediate hinge portion;

a first foot portion extending laterally along said first generally rectangular wing portion and projecting essentially normal from said first generally rectangular wing portion;

a first hook fashioned at a distal end of said first foot portion and laterally extending coextensively with said first foot portion and in a direction generally toward said intermediate hinge portion, said first hook having, first a locking surface extending at an angle of about 15 degrees as measured from an imaginary plane extending normal from said first foot portion and a reversely directed return angle extending at an angle of approximately 40 degrees with respect to a second imaginary plane extending parallel to said first imaginary plane and being located at the distal end of said first foot portion;

a second hook substantially identical to said first hook, said second hook being fashioned at a distal end of said second foot portion and laterally extending coextensively with said second foot portion and in a direction generally away from said intermediate hinge portion, said second hook having, a second locking surface extending at an angle of about 15 degrees as measured from an imaginary plane extending normal from said second foot portion and a reversely directed return angle extending at an angle of approximately 40 degrees with respect to a second imaginary plane extending parallel to said first imaginary plane and being located at the distal end of said second foot portion;

said first and second generally rectangular wing portions being operable to be pivoted about said intermediate hinge portion at an open end of a plastic film bag to be closed and the first and second locking surfaces extending at angles of about 15 degrees interact to mutually engage and retain a collapsed open bag end therebetween and said first and second return angle of approximately 40 degrees accommodating bending and interaction of a bag to be sealed with adjacent surfaces of said first and second generally rectangular wing portions.

2. A plastic film bag closure device as defined in claim 1 wherein:

said first and second generally rectangular wing portions having a width of about 50 mm, the distance between said first and second foot portions being about 30 mm and the height of each of said first and second foot portions being about 7 mm.

3. A plastic film bag closure device as defined in claim 2 wherein: the thickness of each of said first and second wings is between 1.4 and 2.00 mm and the thickness of said intermediate hinge portion is between about 0.7 and 0.9 m.

* * * * *